United States Patent [19]

Amess

[11] 4,072,413

[45] Feb. 7, 1978

[54] ELECTROSTATOGRAPHIC REPRODUCTION METHODS AND MACHINES

[75] Inventor: Colin Lawrence Amess, Welwyn Garden City, England

[73] Assignee: Xerox Corporation, Stamford, Conn.

[21] Appl. No.: 685,478

[22] Filed: May 11, 1976

[30] Foreign Application Priority Data

Oct. 31, 1975 United Kingdom ..... 45375/75

[51] Int. Cl.[2] ..... G03G 15/00

[52] U.S. Cl. ..... 355/3 CH

[58] Field of Search ..... 355/3 CH; 317/262 A; 250/324–326; 96/1 C

[56] References Cited

U.S. PATENT DOCUMENTS 3,241,466 3/1966 Clark ..... 355/3 CH

OTHER PUBLICATIONS

Leopold et al.; "Charge Corona Edge Shield"; *IBM Tech. Discl. Bull.,* vol. 15, No. 7, p. 2060; Dec. 1972.

*Primary Examiner*—William M. Shoop

[57] ABSTRACT

An electrostatic reproduction machine in which imaging radiation is transmitted from a radiation source to selectively discharge a photoconductive insulating layer to form a latent image of a document. The photoconductive layer is arranged to move relative to and in an arcuate path adjacent a charging corotron which is misaligned or skewed with respect to a line parallel to the axis of said arcuate path to produce a non-uniform charge across the layer.

3 Claims, 4 Drawing Figures

ELECTROSTATOGRAPHIC REPRODUCTION METHODS AND MACHINES

BACKGROUND OF THE INVENTION

The present invention relates to an electrostatographic reproduction methods and machines.

In this specification, the expression "electrostatographic reproduction machine" refers to a machine for producing one or more prints or copies from at least one electrostatic latent image. The expression "electrostatographic member" refers to a member for producing and utilizing an electrostatic latent image.

The production of an electrostatic latent image may be carried out in various ways, as is well known. The basic and most conventional electrostatographic process or method id described in U.S. Pat. No. 2,297,691. This method involves producing a uniform electrostatic charge on a photoconductive insulating layer. In practice, it is possible for the insulating layer to have a protective overlayer or other overlayer known in the art of xerography. The charged layer is exposed to imaging radiation (especially light) to discharge selectively the photoconductive layer to form the electrostatic latent image. The latent image may then be developed in any known way. Examples of known development methods, for example, are "cascade development" described in U.S. Pat. No. 2,221,776; and "magnetic brush development" described in U.S. Pat. No. 2,874,063. Another example of a known development method is a liquid development method described in U.S. Pat. No. 3,084,043. In this method, development is carried out with a polar liquid developer. Such a developer is stable, i.e., it will respond to an electrostatic field as a homogeneous unit without separation of the components of the liquid developer. As described in U.S. Pat. No. 3,084,043, the polar liquid developer is applied by a rotatable member having a plurality of raised portions defining a substantially regular patterned surface and a plurality of portions depressed or sunken below the raised portions. The liquid developer is present in the depressed portions and is doctored by a doctor blade.

In present electrostatographic machines the photoconductive layer is charged as far as practically possible uniformly along its length. In such machines imaging radiation is normally directed through an optical system from an original document to be copied. Conventional or even especially designed optical systems exhibit an inherent fall-off of efficiency in the optical components at their extreme fields of view. In well known automatic electrostatographic machines, it is usual to move either the original to be copied or the photoconductive layer during the step of imaging to provide a scanning operation. The radiation is directed through a slit or aperture which regulates the time of exposure. Present day machines often compenstate for fall-off of efficiency by providing a butterfly type aperture in the optical system in a plane at right angles to the line of scanning. A butterfly type aperture is wider at its extremities so as to allow more radiation in the extremes of the field of view than in a central region, thereby correcting for the lower light intensity. With some limitations this compensation has proved generally satisfactory. Copending application Ser. No. 654,301, filed on Feb. 2, 1976 suggests the use of a differentially charged photoconductive layer as a means for compensating for fall-off, the differential charge being created by a uniform charging step followed by a non-uniform discharge step in which the photoconductor is exposed to a non-uniform radiation source.

SUMMARY OF THE INVENTION

According to the invention there is provided an electrostatographic reproduction machine in which imaging radiation is transmitted from a radiation source to selectively discharge a photoconductive insulation layer to form a latent image of a document or other information, including charging means arranged to differentially charge said layer such that said layer is relatively more highly charged centrally to compensate in the formation of said latent image for differential reductions of the imaging radiation. The charging means comprises a corotron arranged adjacent a photoconductive surface which moves along an arcuate path, the axis of the corotron being misaligned with respect to the line parallel to the axis of the arcuate path.

BRIEF DESCRIPTION OF THE DRAWINGS

Electrostatographic reproduction methods and machines according to the invention will now be described by way of example with reference to the accompanying drawings in which.

DESCRIPTION OF THE PREFERRED EMBODIMENTS

Figure 1:
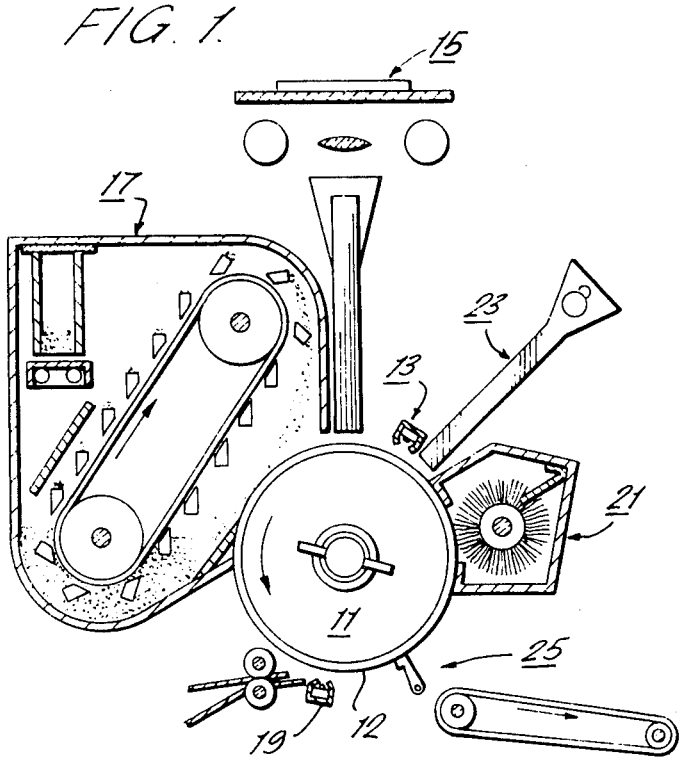
FIG. 1 shows schematically for illustrative purposes an electrostatographic copying machine.

Referring to the drawings, FIG. 1 is generally illustrative of a conventional automatic electrophotographic reproduction apparatus. A drum 11 supports a photoconductive insulating layer 12. In use, the layer 12 is first passed in sequence through a charging station 13 at which a uniform electrostatic charge is deposited on the surface 12. The surface 12 is then passed through exposure station 15, where an original (not shown) is supported, at which a light or radiation pattern is projected onto the surface 12 to dissipate the charge in the exposed areas thereof and thereby form an electrostatic latent image of the original. Next, the surface 12 is passed through the developing station 17 at which a developing material including toner particles having an electrostatic charge opposite to that of the electrostatic latent image is cascaded over the surface 12 whereby a portion of toner particles adhere to the electrostatic image to form a powdered image in the configuration of the original to be reproduced. After developing the electrostatic latent image, the surface 12 passes through transfer station 19 at which the powder image is electrostatically transferred from the surface 12 to a transfer material or sheet. Thereafter, the surface 12 is brushed at station 21 to remove any residual toner particles remaining on the surface 12 in preparation for the next cycle.

After the development step and prior to the transfer step, the transfer sheet is fed into with the surface 12, and driven by the surface 12. The sheet may be any conventional size and made of semi-flexible material such as paper, plastic film, etc. The stripping apparatus designated as 25 is positioned adjacent the surface 12 subsequent in sequence to the image transfer station 19, and prior to the cleaning station 21. It is necessary to remove the sheet to a location remote from the surface 12. For instance, once a sheet is removed from the vacinity of the surface 12, the toner image can be fused to the sheet or otherwise made permanent without any deleterious side effect to the surface 12.

It is believed that the foregoing description is sufficient for purpose of this application to show the general operation of a known electrostatographic reproducing apparatus and incorporating cascade development.

Figure 2:
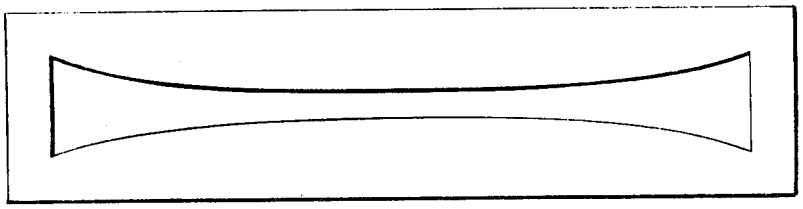
FIG.2 shows schematically a typical butterfly type aperture for use in the copying machine of FIG. 1.

In the machine of FIG. 1, a single illustrative lens is shown for directing the radiation from the exposure station 15 to the surface 12. As the transmission efficiency of the lens is less efficient at its edges the imaging radiation pattern received at and towards the extreme regions of the drum surface is more reduced during transmission from the exposure station that the radiation pattern in a central region. In electrostatographic machines of the type described and in other electrostatographic machines having other development systems, for example, magnetic brush and liquid development system, it is usual to compensate for this fall-off of radiation caused by the reduced efficiency of an optical component or system by introducing a butterfly type aperture (see FIG. 2) in the path of the radiation. The aperture is conventionally placed near the drum surface. The aperture increases the overall radiation energy reaching the photoreceptor drum surface at the extreme regions by allowing a broader image to reach the surface of the photoreceptor drum. Without the compensation provided by a butterfly type aperture, copies produced by the machines would at least tend to be under exposure at their edges. Considerable effort has so far been directed to the design of the precise configuration of butterfly apertures.

Hitherto, compensation for the fall-off at the extremes of a radiation pattern due to inherent optical system inefficiency at the wide field of view has not been provided in machines other than optically, that is, other than by providing a butterfly aperture and/or optimising widefield response of all active components of the optical system.

It has already been explained that an aperture is conventionally provided to compensate for reduction of exposure at the extreme regions of the surface of the drum. However, it is inherent, in a conventional optical system that an increased aperture opening at the ends of the aperture disadvantageously introduces a fall-off of resolution of the image. If the butterfly aperture is replaced by a narrow parallel sided slit, then good resolution, even at the edge of a copy is maintained. It is possible according to the present invention to provide compensation to prevent under-exposure at the edges by differential charging alone. Additionally, we can also provide where possible, a butterfly type aperture (not shown) to aid compensation, in which case the butterfly type is less wide at its extremities than required without differential charging.

Development of images in magnetic brush or liquid development is dependent on the absolute value of the charge of the latent image rather than differences of charge level as between say black and white regions of latent images. (Differences of charge level being relied upon in cascade development, for example). In the simple case, using liquid development, a light (white) image is developed where the latent image charge level is around 300 volts or less and a dark (black) image is developed where the latent image voltages is above about 580 volts. Conventionally, the photoreceptor layer of a liquid development machine is charged uniformly to around 650 volts before imaging. The intensity of radiation representing white images must then be sufficient to cause discharge of the appropriate parts of the surface of the photoreceptor from 650 volts to 300 volts. However, the intensity of radiation reaching the photoreceptor representing white parts of the original document being copied is relatively less at the edges of the photoreceptor due to reduced efficiency of the optical system at the wide angle. This means that the intensity of radiation representing white may not be quite sufficient at the edges to provide the required reduction in surface voltage level of the photoreceptor in those regions. In accordance with this invention, we differentially charge the photoreceptor layer to compensate for the reduction in transmission efficiency. This is illustrated for liquid development in FIG. 3 where it will be seen that we reduce the voltage level of charge at the edges of the photoreceptor. The amount of discharge now required to reduce the voltage to the white level at the edges, in our simple case, is less. This compensates for the differential reductions of the imaging radiation caused by its transmission from the radiation source of the photoreceptor.

There are already electrostatographic copying machines which incorporate lasers arranged to "write" on photoconductive surfaces by selectively exposing parts of the surfaces. The present invention is particularly useful in such copying machines as it is not possible to compensate for variations in the transmission efficiency or variations of scanning speed by using shaped apertures in such machines. However, differential charging of the photoconductive insulating layer as described provides a technique of compensation of variations in illumination of a laser beam or other small area radiation energy beam.

Figure 3:
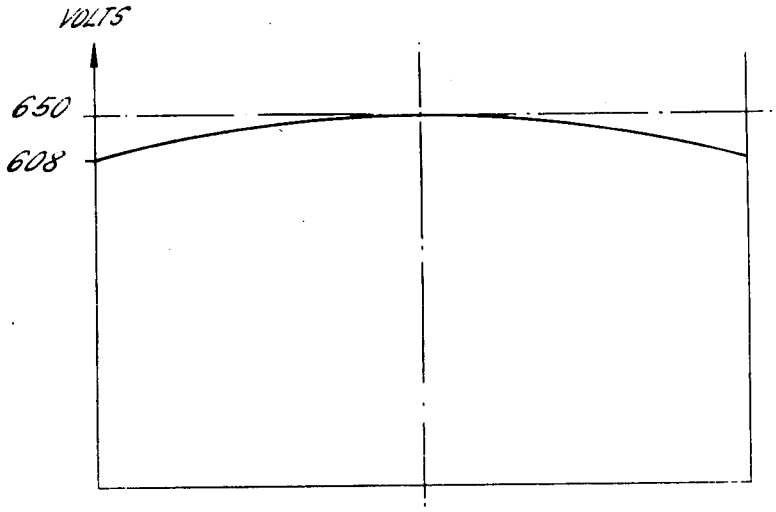
FIG. 3 shows graphically the level of charge across a differentially charged photoreceptor drum surface.
Figure 4:
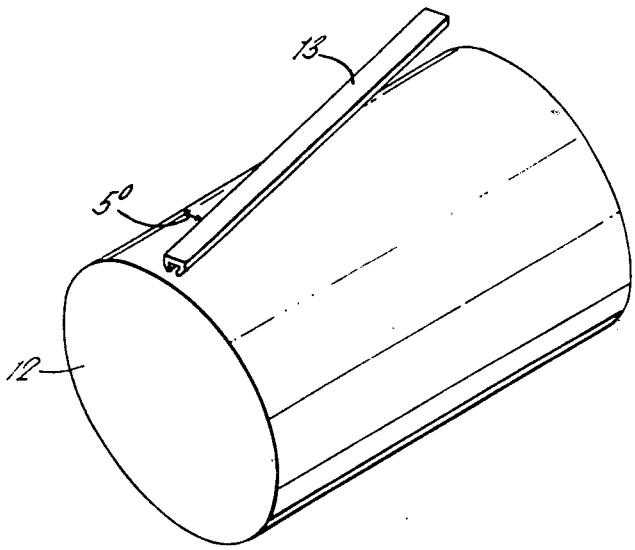
FIG. 4 shows schematically a charging system for differentially charging said photoreceptor.

For one laser writing system, incorporating a liquid development we arrange a moving drum-like photoreceptor with a charge profile generally similar to that illustrated in FIG. 3, for example, by misaligning the charging corotron as shown in FIG. 4.

The laser directs light in the form of a travelling spot onto the photoreceptor. The scanning is achieved using a rotating reflecting polygon (not shown) which causes the beam to sweep along the photoreceptor surface parallel to the axis of the photoreceptor to "write" in line-by-line fashion. The polygon is positioned centrally with respect to the axial length of the photoreceptor so that the spot travels inherently, although generally marginally, more quickly at the extreme ends of the photoreceptor. This means that less radiation per unit length falls in the region of the edges of the photoreceptor than around the central region because of the variation in speed. Further, as the edges are further from the radiation source than the central region the radiation is also less at the edges because of the increase of distance. Thus, there is therefore less radiation available at the edges to discharge the photoreceptor layer to form white representing latent images. Without the provision of differential charging copies are produced which tend to be under-exposed at their edges.

In FIG. 4, the corotron 13 is 26 cm. in length and is arranged at an angle of approximately 5° to the axis of the photoreceptor 12. The corotron 13, which is displaced about 3 mm. from surface of the photoreceptor at the center, is displaced about 12 mm. from the photoreceptor surface at the edges. In the copying machine described this causes the photoreceptor layer to be charged at around 650 volts at the center and 608 volts at the edges.

The level of charge along the surface layer of the photoreceptor, as is shown in FIG. 3, follows a curve which conveniently tends to match typical fall-off of radiation due to transmission through standard optical transmission components and/or the variation of scan speed in a typical laser scanning system and distance from the radiation source. The compensation provided by differential charging is attractive especially as compared to other solutions such as optical solutions to provide especially designed optical components or mechanical solutions to provide a variable rotational drive for the polygon, for example.

It will be appreciated that the degree of "misalignment" of the corotron 13 controls the difference of the voltage as between central regions and edges to which the photoreceptor layer can be charged. As the angle of misalignment increases so does the difference of the voltage. When choosing the angle of misalignment, consideration include the transmission characteristic of any optical components in the optical system, variations in the scanning speeds if a polygon or similar beam scanning system is used, the charging characteristics of the corotron including the magnitude of the charging current to be used, the speed of rotation of the photoreceptor (or speed of travel of a flat photosensitive surface if such is used), and also those characteristics of the development system (e.g., liquid or magnetic brush) which determine the optimum development of latent images on the photoreceptor. It will be noted that if the corotron is moved further away from the photoreceptor layer, the effect of misalignment is less. Thus, where a very shallow characteristic is required difficulty may arise in setting up a very small misalignment angle. The desired differential charging profile may be more readily achieved in such a situation by increasing the separation of the corotron and the photoreceptor layer and possibly using a larger misalignment angle which tends to be more easily set up accurately in the machine.

Although many factors have clearly to be taken into account in determining an optimum angle of misalignment of the corotron, as has been mentioned above, provides a simple solution which tends to provide compensation not only at the central region and edges but also at all intermediate positions. That is, the charge level variations along the length of photoreceptor caused by misalignment of the corotron to differentially charge the photoreceptor layer tend to match the required graduated compensation as we have found is required in practice to produce satisfactory copies.

It will be appreciated that the misalignment of the corotron may be used to cause differential charging of a flat albeit flexible photoreceptor surface layer. The differential charging is achieved by moving the flat layer in an arcuate path adjacent the corotron, the corotron being misaligned in respect to a line parallel to the axis of the arcuate path.

While particular embodiments of the invention has been described above it will be appreciated that various modifications may be made by one skilled in the art without departing from the scope of the invention as defined in the appended claims.

What is claimed is:

1. An electrostatographic reproduction machine in which imaging radiation is transmitted from a insulation layer to form a latent image of a document or other information, including a charging corotron arranged to differentially charge said layer such that said layer is relatively more highly charged centrally to compensate in the formation of said latent image for differential reductions of the imaging radiation, said layer being arranged to be moved relative to and in an arcuate path adjacent said corotron which is misaligned with respect to a line parallel to the axis of said arcuate path.

2. An electrostatographic reproduction machine according to claim 1, in which said arcuate path comprises a drum surface.

3. An electrostatographic reproduction machine according to claim 1, in which said misalignment is around 5° to said axis.

* * * * *